US007012525B1

(12) United States Patent
Ghioto

(10) Patent No.: US 7,012,525 B1
(45) Date of Patent: Mar. 14, 2006

(54) SANITARY SECURITY SOCK SYSTEM

(76) Inventor: Diane Ghioto, 328 Noyac Rd., South Hampton, NY (US) 11968

( * ) Notice: Subject to any disclaimer, the term of this patent is extended or adjusted under 35 U.S.C. 154(b) by 133 days.

(21) Appl. No.: 10/717,371

(22) Filed: Nov. 19, 2003

(51) Int. Cl.
*G08B 13/18* (2006.01)

(52) U.S. Cl. ..... 340/552; 340/999; D2/980; 2/239

(58) Field of Classification Search ..... 340/552, 340/551; D2/986, 980; 2/239; 36/9 R, 36/10
See application file for complete search history.

(56) References Cited

U.S. PATENT DOCUMENTS 4,598,485 A * 7/1986 Joe et al. ..... 36/7.2
5,404,657 A * 4/1995 Honeycutt ..... 36/10
5,575,013 A * 11/1996 Krack ..... 2/239
5,617,585 A * 4/1997 Fons et al. ..... 2/239
5,763,337 A * 6/1998 Montgomery ..... 442/398
6,067,659 A * 5/2000 Reichle ..... 2/239
6,507,278 B1 * 1/2003 Brunetti et al. ..... 340/541
6,724,304 B1 * 4/2004 Risi ..... 340/540
6,888,460 B1 * 5/2005 Ambrefe, Jr. ..... 340/541
2003/0154625 A1 * 8/2003 Royle ..... 36/7.3
2003/0213184 A1 * 11/2003 Hunt et al. ..... 52/36.1
2004/0098237 A1 * 5/2004 Pendergraft et al. ..... 703/7
2005/0057354 A1 * 3/2005 Jenkins et al. ..... 340/522

* cited by examiner

*Primary Examiner*—Jeffery Hofsass
*Assistant Examiner*—Eric Blount
(74) *Attorney, Agent, or Firm*—Shumaker, Loop & Kendrick; Alejandro J. Fernandez

(57) ABSTRACT

A plurality of socks each has a closed end, an open end and an intermediate extent there between. Each sock has an elastomeric pad. The pads each have an upper face in secure contact to the intermediate extent. The pads each have a lower face with projections in rows and columns integrally formed with the pad for traction purposes. The socks are designated "one size fits all" and are arranged in pairs. A plurality of containers containing pairs of socks of a common size are to be selected by a passenger to be screened for security purposes.

6 Claims, 3 Drawing Sheets

FIG 5
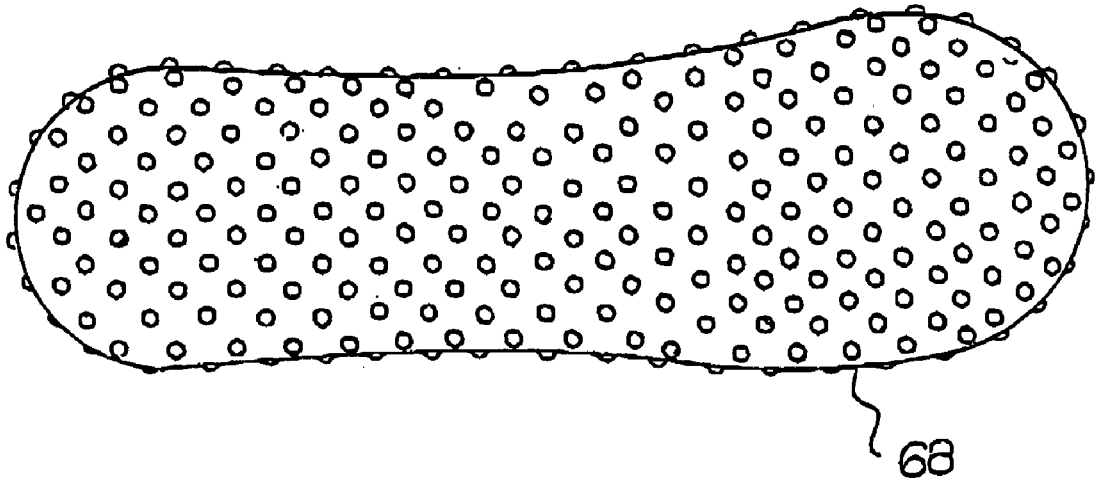
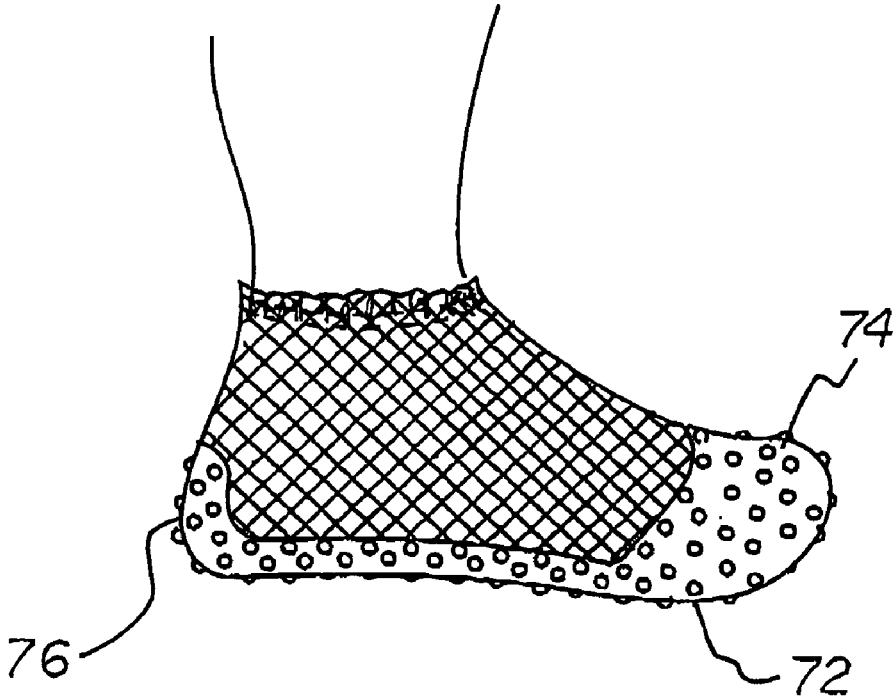
FIG 6

SANITARY SECURITY SOCK SYSTEM

BACKGROUND OF THE INVENTION

1. Field of the Invention

The present invention relates to a sanitary security sock system and more particularly pertains to facilitating the screening of airline passengers in a secure, sanitary and efficient manner.

2. Description of the Prior Art

Each day, hundreds of thousands of people board commercial airplanes to fly to various destinations around the world. As part of the traveling process, passengers are required to arrive at the airport hours before their scheduled departure time to ensure that there is sufficient time to participate in the often slow and daunting security screening procedure. With the increase in airport security measures, many recent inventions have focused on improving the accuracy and efficiency of current airport security systems. However, none of these inventions have focused on the health concerns that have surfaced as a result of the implementation of the new security standards.

As part of the airport security process, passengers are required to remove their shoes from their feet and place them on a conveyor belt for x-ray screening. Once the shoes are placed on the conveyor belt, passengers are required to walk, in their stocking or bare feet, through the security metal detection station.

Unfortunately, little or no emphasis has been placed on the potential transmission of communicable fungal infections from one passenger to another during the security screening process. Various fungal infections of the skin or nails on the feet, including athlete's foot (tinea pedis), can be transmitted by direct contact or by contact with objects such as clothing, shoes, nail clippers, nail files, shower and locker room floors, and most importantly, carpet.

This sanitary security sock system therefore provides an effective, cost-efficient, sanitary method to prevent the spread of various communicable fungal infections of the skin or nails of the foot from one passenger to another during the security screening process, by requiring each passenger to wear a disposable, antifungal sock while walking through the security metal detection station.

The use of security systems is known in the prior art. More specifically, security systems previously devised and utilized for the purpose of screening people for security purposes are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,584,704 issued Jul. 1, 2003 to March, discloses a "Disposable Shoe Cover." The invention comprises a disposable, elastic shoe cover for protecting shoes against inclement weather conditions and sharp or abrasive objects. The shoe cover material may be translucent or clear so that the shoe may be seen through the shoe cover material, and the elasticity of the material allows the shoe cover to hug the shoe to minimize slipping between the shoe and the shoe cover. Generally, the shoe cover will have the following characteristics: waterproof, elastic, transparent or translucent, breathable, durable, pliable, resistant to abrasion and/or puncture, and non-allergenic. Moreover, the bottoms may be textured to increase frictional contact with the street, sidewalk, floor, ice, snow, etc., thus, reducing the likelihood of slipping on such surface.

U.S. Pat. No. 2,652,637 issued Sep. 22, 1953 to Hardman, discloses a "One-Piece Foldable Overshoe." The invention comprises a light, flexible, water and abrasion resistant overshoe that is formed as an integral thin structure of flexible homogeneous plastic with a foot portion and an ankle portion. The foot portion has a flat sole, a short toe and a heel portion. The sole, heel and toe portions are of increased thickness for increased strength. The ankle portion is of such diameter as to readily admit the wearer's foot. Complementary fastener members are provided to secure the overshoe in a closed position so that the overshoe remains in place on the wearer's foot. The overshoe shall also be transparent or translucent, and may be constructed of various materials, such as natural or synthetic rubber, or various copolymers which form tough, flexible semi-solids when polymerized.

U.S. Pat. No. 6,209,227 issued to Swango et. al., discloses a "Shoe Cover with Slip-Resistant Sole." The invention comprises a shoe or foot covering with slip-resistant portions made from a polymeric material that are applied to the bottom surface of the foot covering. The top edges of the foot covering include a strip of elastic material to provide an expandable opening so that the covering will be form fitting about the wearer's ankle. The bottom edge of the foot covering is also expandable by being secured to another strip of elastic material so that the shoe cover fits snugly about the toe and heel portions of the sole.

U.S. Pat. No. 5,644,813 issued Jul. 8, 1997 to Puskas, discloses a "Disposable Overshoe Mop." The invention comprises a stretchable, waterproof structure for covering a shoe or foot worn by a person so as to protect the shoe or foot from water and dirt. A component is affixed to the bottom of the covering structure for cleaning a floor. The covering structure snugly fits about the shoe, foot or ankle of the person and has an entrance aperture for the shoe or foot to be inserted therethrough.

U.S. Pat. No. 3,798,503 issued Mar. 19, 1974 to Larsh et. al., discloses a "Protective Foot Cover." The invention comprises a flexible, sanitary and protective foot and shoe cover that may be formed of a suitable plastic or of a material having a plastic portion in the seam areas. The top opening of the cover accommodates the leg of the wearer. The cover includes a continuous seamless bottom sole portion and a top portion having a forward toe and rear heel seam extending upwardly from the sole portion to the leg opening. An elastic band is provided about the opening and through the forward toe seam to provide a covering over the foot which generally conforms to the foot and is resiliently attached thereto. A conductive tape is sewed to the seamless sole portion and is extended upwardly through the protective cover at the non-elasticized heel seam.

U.S. Pat. No. 5,617,585 issued Apr. 8, 1997 to Fons et. al., discloses a "Rubber Soled Slipper Sock." The invention comprises a slipper sock having a rubber sole liner that is formed by embedding the sock within uncured, liquid latex rubber. The sock has a fabric sole, and the liner is securely bonded to the sock and protects the fabric sole from abrasion and protects the wearer's foot from sharp objects and extreme temperatures, while the liner remains physically separate and apart from the fabric sole. The sock also has a sleeve opening at the top for providing access for the foot of a wearer that further comprises an elastic rim which gathers against the ankle or leg of the wearer, thereby preventing drafts from entering the interior of the slipper sock.

U.S. Pat. No. 3,017,705 issued Jan. 23, 1962 to Peters, discloses a "Foot and Leg Apparel Article." The invention comprises a boot with a foot portion and a leg portion rising from the foot portion. The foot portion includes a sole and a heel connected together by an instep. The sole, heel, and instep are fabricated of a thicker plastic sheet than is the leg portion which is fabricated of flexible and transparent plastic material. The invention further provides strap means on the foot portion for securement of the foot portion to the foot of the wearer. The invention is fabricated so that the foot portion is of a size to encompass the foot of a wearer when encased in a shoe. The leg portion further provides an elastic ring of such tension as to hold the leg portion on the leg of the individual without causing the trouser leg to become wrinkled.

U.S. Pat. No. 6,014,822 issued Jan. 18, 2000 to Smith, discloses "Foot Cover Inserts for Sandals." The invention comprises a foot cover insert that is slid over a wearer's foot and covers the instep and sides of the foot for keeping feet inside the straps of sandal shoes. The foot cover insert has an upper portion consisting of a clear, smooth, firm, pliable, vinyl material, and a flat sole consisting of a thin cork material or a heavy grain fabric material. The upper portion and the sole are joined together at their edges to form a tubular shaped member with an enlarged first opening to permit the insert to be slid over the wearer's foot, and an enlarged second opening at the front of the tubular member. The insert shall cover only the portion of the foot between the toes and the instep wherein the foot cover insert can be removed and placed in any type of sandal.

U.S. Pat. No. 4,616,429 issued Oct. 14, 1986 to Alcala, discloses a "Disposable Shoe Cover." The invention comprises a disposable shoe cover and method of making same from two source rolls of flat, flexible material. The invention is intended to provide protection to sterile environments such as hospital operating rooms, laboratories, etc. The shoe cover is formed from two flat panels that are glued together to form a shoe-shaped enclosure with a toe seam portion and an opening for receiving the shoe of the wearer. The shoe cover may be made out of TYVEK7 material or other material capable of being secured by adhesive. Elastic is provided around the opening and in the toe seam portion to keep the shoe cover in place snuggly on the wearer's shoes, and to enable the shoe cover to fit a wide range of shoe sizes and styles.

U.S. Pat. No. 4,204,345 issued May 27, 1980 to Bradley, discloses a "Sock." The invention comprises a lightweight, flexible, and air permeable plastic sock having a toe portion, a heel portion, and an upper portion that is adapted for use in combination with a boot or galosh, facilitating insertion of the foot therein and to keep feet dry while the overboot is worn. The sock is formed so that an open end is provided for insertion of the foot with or without a shoe. The open end further comprises a rim portion that includes elastic means for securing the sock about the leg of a user. The other end of the sock is closed.

U.S. Pat. No. 3,283,422 issued Nov. 8, 1966 to Nygard, discloses a "Disposable Overshoe." The invention comprises disposable triangular shaped overshoes which are formed from filmy plastic material. An opening at the top portion of the overshoe receives the foot of the wearer when the overshoe is to be worn.

U.S. Pat. No. 3,426,454 issued Feb. 11, 1969 to Mitchell et. al., discloses "Plastic Footwear and Methods for Fabrication." The invention comprises slippers made out of stretchy, elastic synthetic polymer sheet material with a heel structure that includes two side portions that meet and are secured to one another along a seam at the rear of the heel. The seam meets the upper edges of the side portions in such a way as to reduce tearing tendencies of the seam.

U.S. Pat. No. 6,067,731 issued May 30, 2000 to Chen et. al., discloses a "Medical Shoe Cover and Method of Forming Thereof." The invention comprises a thin elastomeric material having a pair of side panels with a foot shaped portion, an ankle shaped portion and an outer perimetric edge. A bead shaped perimetric section joins the two side panels at their respective perimetric edges, except at the upper edge of the ankle portions. A traction enhancing embossed pattern is formed on a lower portion of the foot shaped portion of the side panels.

U.S. Patent Application No. 2002/0069553 filed by March, discloses a "Disposable Shoe Cover." The invention comprises a disposable, elastic shoe cover for protecting shoes against inclement weather conditions and sharp and abrasive objects. The shoe cover material may be translucent or clear and the elasticity of the material allows the shoe cover to hug the shoe to minimize slipping between the shoe and the shoe cover. The shoe cover has a front portion, a rear portion, and a sole portion. The shoe cover may be pulled onto a shoe or may be in part unrolled directly onto the shoe. Additionally, the bottoms may be textured to increase frictional contact with the street, sidewalk, floor, ice, snow, etc.

U.S. Patent Application No. 2001/0025433 filed by Swango et. al., discloses a "Shoe Cover with Slip-Resistant Sole," and is a continuation of U.S. Pat. No. 6,209,227. The invention comprises a shoe or foot covering with slip-resistant portions made of a polymeric material that are applied to the bottom surface of the foot covering. The top edges of the shoe cover also contain a strip of elastic material to provide an expandable opening so as to be form fitting about the wearer's ankle.

U. S. Patent Application No. 2002/0148138 filed by Egan, discloses "Smart Tread Boot Covers." The invention comprises a shoe or boot cover made of canvas, nylon, denim or cotton, and the cover is adapted to slip over a workman's shoes to protect floors and carpets from dirt and deleterious materials carried in from outside. The cover has an elasticized upper open seam and a flat combined sole and heel portion made of non-skid neoprene or rubber. The body and sole-heel portion are attached by adhesive or stitching. The cover is washable and reusable.

World Intellectual Property Organization Patent No. WO 96/15691 filed by Taylor-Haasz discloses "Overshoes" that comprise an overshoe that is formed of resilient, deformable plastic material and includes an upwardly open chamber into which the user places his foot. The chamber has a base and an upwardly extending wall having an inwardly projecting rib which is displaced outwardly on insertion of a foot into the chamber so that a resilient gripping action is exerted by the wall to hold the overshoe in position on the foot.

While these devices fulfill their respective, particular objectives and requirements, the aforementioned patents do not describe a sanitary security sock system that allows facilitating the screening of airline passengers in a secure, sanitary and efficient manner.

In this respect, the sanitary security sock system according to the present invention substantially departs from the conventional concepts and designs of the prior art, and in doing so provides an apparatus primarily developed for the purpose of facilitating the screening of airline passengers in a secure, sanitary and efficient manner.

Therefore, it can be appreciated that there exists a continuing need for a new and improved sanitary security sock system which can be used for facilitating the screening of airline passengers in a secure, sanitary and efficient manner. In this regard, the present invention substantially fulfills this need.

SUMMARY OF THE INVENTION

In view of the foregoing disadvantages inherent in the known types of security systems now present in the prior art, the present invention provides an improved sanitary security sock system. As such, the general purpose of the present invention, which will be described subsequently in greater detail, is to provide a new and improved sanitary security sock system and method which has all the advantages of the prior art and none of the disadvantages.

To attain this, the present invention essentially comprises an entrance station for airline passengers to be screened for security purposes, which includes a plurality of socks. Each sock is fabricated of a tubular knit and has a closed end and an open end. An intermediate extent is provided between the closed end and the open end. The closed end has a line of closure stitching, which is positionable adjacent to a passenger's toes. The open end has an elastic band that is positionable around a passenger's ankle. Each sock has an elastomeric pad that is fabricated of an elastomer, which is selected from a class of elastomers, including plastic and rubber, natural and synthetic, and natural and synthetic blends. The pad is in a generally rectangular configuration and has a width, which is less than half the intermediate extent, and a length, which is less than the length of the tubular knit. The pad is positioned closer to the closed end than to the open end. The pads each have an upper face that is held in secured contact to the intermediate extent of the tubular knit. Each pad has a lower face with projections that are provided in rows and columns and are integrally formed with the pad for traction purposes. The socks are designated "one size fits all" and are arranged in pairs. The entrance station also has a plurality of containers that contain pairs of socks of a common size. The pairs of socks are to be selected by a passenger to be screened.

A metal detection station is provided, which includes opposed vertical plates that are adapted to detect metal and generate a warning signal to an attendant upon a passenger walking between the plates if metal is on the passenger's person. The opposed vertical plates do not generate a warning signal upon a passenger walking between the plates if no metal is on the passenger's person. The person walking between the plates is adapted to remove his/her shoes prior to walking between the plates. The person walking between the plates puts on a pair of socks selected from a container of an appropriate size.

Provided next is an x-ray detection station, which includes an x-ray camera and a plastic tray. The plastic tray is movable beneath the x-ray camera. The plastic tray is adapted to receive a passenger's shoes after a passenger has removed his/her shoes and then selected a pair of socks and put them on his/her feet. The plastic tray, containing a pair of shoes, is adapted to be fed beneath the x-ray camera. In this manner, objects which might be a security risk are detected while the passenger is walking between the plates.

Provided last is an exit station, which includes a trash basket for each passenger's pair of socks after each passenger has passed through the metal detection station while wearing the socks and has had his/her shoes passed beneath the x-ray camera.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sanitary security sock system which has all of the advantages of the prior art security systems and none of the disadvantages.

It is another object of the present invention to provide a new and improved sanitary security sock system which may be easily and efficiently manufactured and marketed.

It is further object of the present invention to provide a new and improved sanitary security sock system which is of durable and reliable constructions.

An even further object of the present invention is to provide a new and improved sanitary security sock system which is susceptible of a low cost of manufacture with regard to both materials and labor, and which accordingly is then susceptible of low prices of sale to the consuming public, thereby making such sanitary security sock system economically available to the buying public.

Even still another object of the present invention is to provide a sanitary security sock system for facilitating the screening of airline passengers in a secure, sanitary and efficient manner.

Lastly, it is an object of the present invention to provide a new and improved sanitary security sock system. A plurality of socks each has a closed end, an open end and an intermediate extent there between. Each sock has an elastomeric pad that has an upper face in secure contact to the intermediate extent. The pads each have a lower face with projections in rows and columns integrally formed with the pad for traction purposes. The socks are designated "one size fits all" and are arranged in pairs. A plurality of containers containing pairs of socks of a common size are to be selected by a passenger to be screened for security purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiment of the invention as well as alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a bottom view of a sock constructed in accordance with an alternative embodiment of the invention.

FIG. 6 is a side elevational view of a sock constructed in accordance with another alternative embodiment of the invention.

DESCRIPTION OF THE PREFERRED EMBODIMENT

Figure 1:
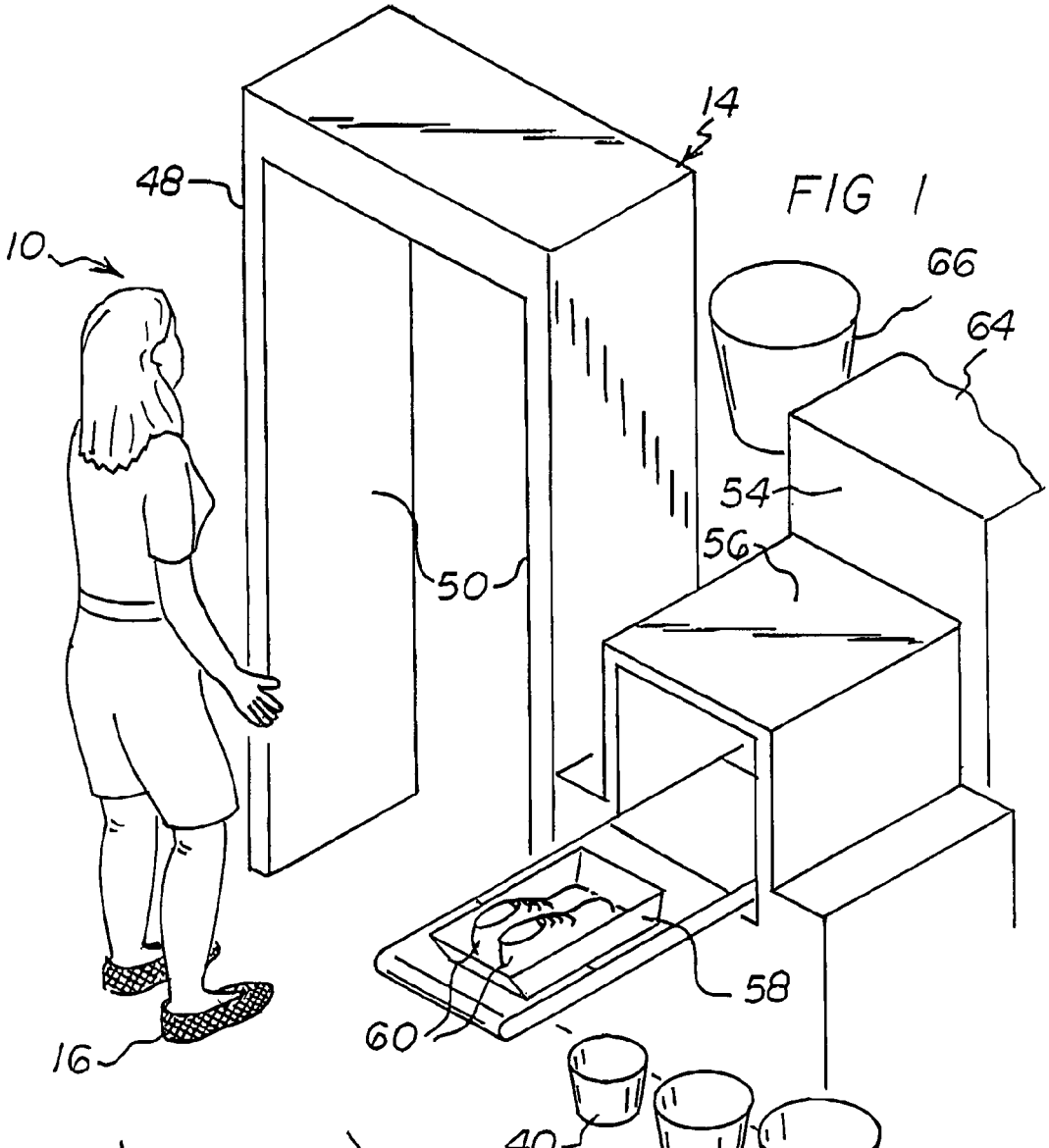
FIG. 1 is a perspective illustration of the sanitary security sock system constructed in accordance with the principles of the present invention.
Figure 4:
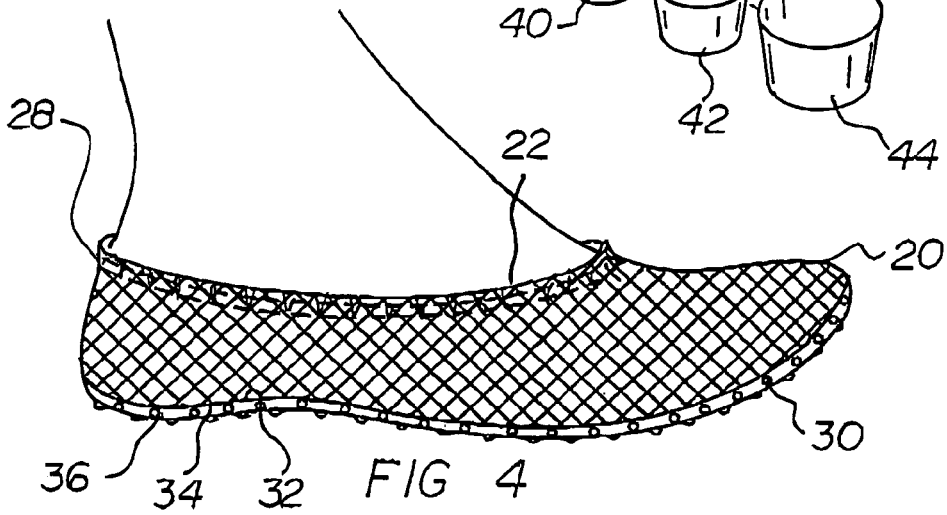
FIG. 4 is an enlarged side elevational view of the sock shown in the prior Figures.
Figure 3:
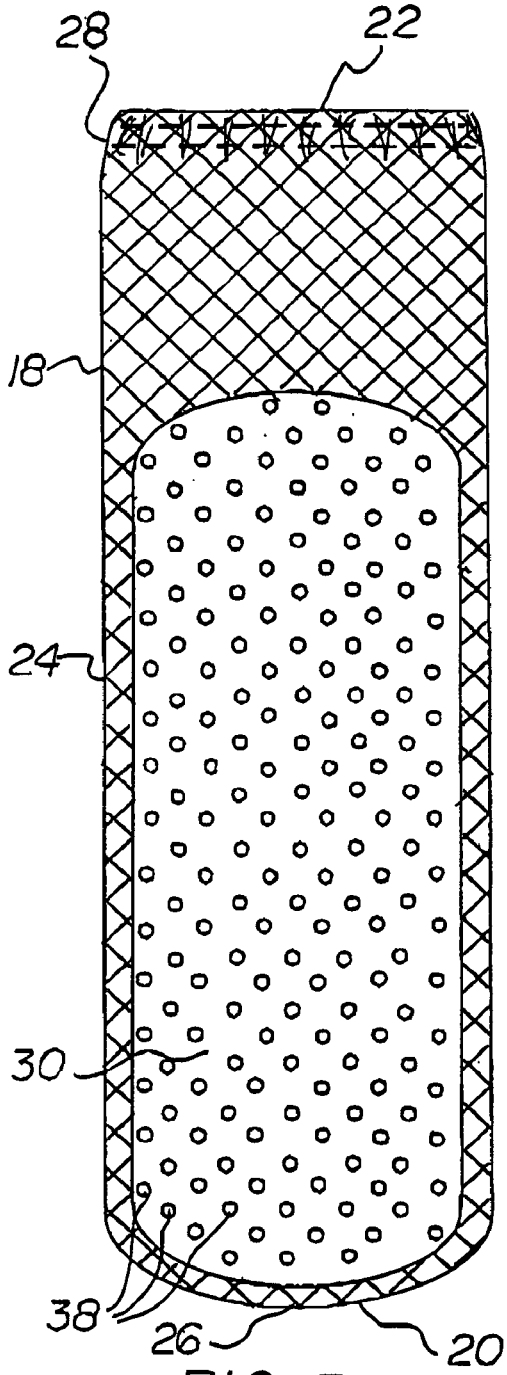
FIG. 3 is an enlarged bottom view of the sock shown in FIGS. 1 and 2.
Figure 2:
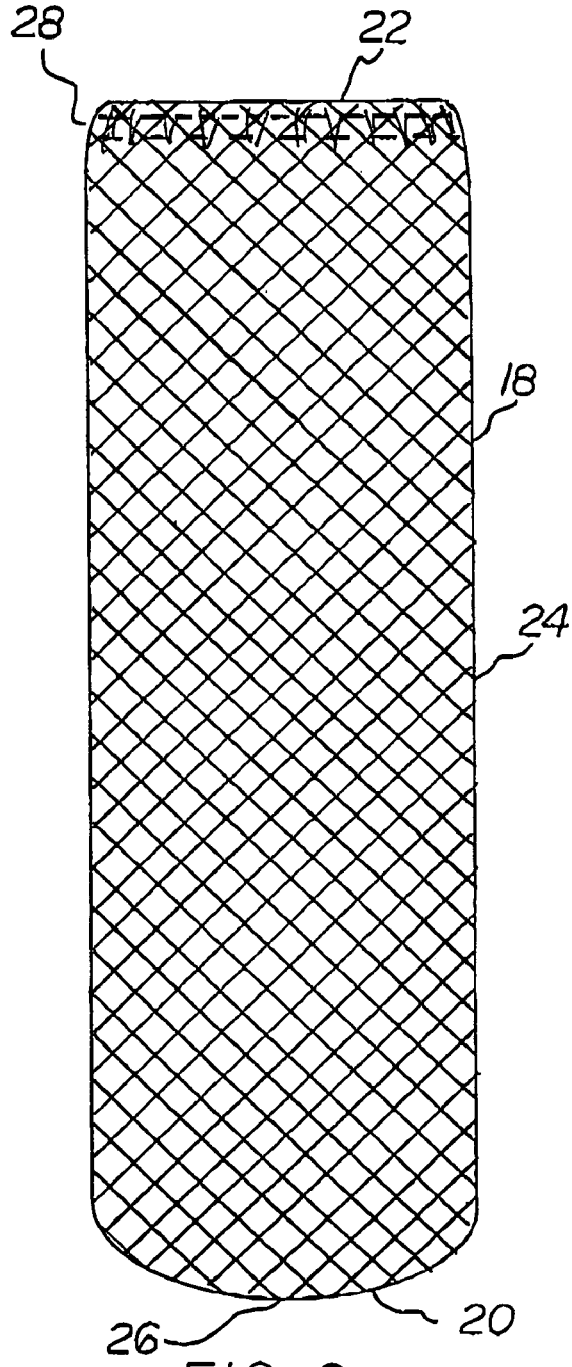
FIG. 2 is an enlarged plan view of the sock shown in FIG. 1.

With reference now to the drawings, and in particular to FIG. 1 thereof, the preferred embodiment of the new and improved sanitary security sock system embodying the principles and concepts of the present invention and generally designated by the reference numeral 10 will be described.

The present invention, the sanitary security sock system 10 is comprised of a plurality of components. Such components in their broadest context include a plurality of socks and a plurality of containers. Such components are individually configured and correlated with respect to each other so as to attain the desired objective.

First provided is an entrance station 14 for airline passengers to be screened for security purposes. The entrance station includes a plurality of socks 16. Each sock is fabricated of a tubular knit 18. Each sock has a closed end 20 and an open end 22. An intermediate extent 24 is provided between the closed end and the open end. The closed end has a line of closure stitching 26. The line of closure stitching is positionable adjacent to a passenger's toes. The open end has an elastic band 28. The elastic band is positionable around a passenger's ankle. Each sock has an elastomeric pad 30. The elastomeric pad is fabricated of an elastomer, which is selected from a class of elastomers, including plastic and rubber, natural and synthetic, and natural and synthetic blends. The pad is in a generally rectangular configuration with a width less than half the intermediate extent and a length less than the length of the tubular knit. The pad is positioned closer to the closed end than to the open end. The pads each have an upper face 32. Each upper face is held in secured contact to the intermediate extent of the tubular knit. Each pad has a lower face 36. The lower face has projections 38. The projections are provided in rows and columns and are integrally formed with the pad for traction purposes. The socks are preferably designated "one size fits all," and are arranged in pairs. In the alternative, a plurality of different sized socks are utilized. The entrance station also has a plurality of containers 40, 42, 44. Each container contains pairs of socks of a common size. The pairs of socks are to be selected by a passenger to be screened.

A metal detection station 48 is provided. The metal detection station includes opposed vertical plates 50. The opposed vertical plates are adapted to detect metal and generate a warning signal to an attendant upon a passenger walking between the plates if metal is on the passenger's person. The opposed vertical plates do not generate a warning signal upon a passenger walking between the plates if no metal is on the passenger's person. The person walking between the plates is adapted to remove his/her shoes prior to walking between the plates. The person walking between the plates puts on a pair of socks selected from a container of an appropriate size.

Provided next is an x-ray detection station 54. The x-ray detection station includes an x-ray camera 56. The x-ray detection station also includes a plastic tray 58. The plastic tray is movable beneath the x-ray camera. The plastic tray is adapted to receive a passenger's shoes 60 after a passenger has removed his/her shoes and then selected a pair of socks and put them on his/her feet. The tray containing a pair of shoes is adapted to be fed beneath the x-ray camera. In this manner, objects which might be a security risk are detected while the passenger is walking between the plates.

Provided last is an exit station 64. The exit station includes a trash basket 66 for each passenger's pair of socks after each passenger has passed through the metal detection station while wearing socks and has had his/her shoes passed beneath the x-ray camera.

In an alternate embodiment of the present invention, the pad 68 is of an elongated configuration and has a curved front edge and a curved rear edge. Note FIG. 5.

In another alternate embodiment of the present invention, the pad 72 is of an extended configuration. A front portion 74 is provided that extends over a wearer's toes. A rear portion 76 is also provided that extends up the back of a wearer's ankle. Note FIG. 6.

In the interest of making the entire security process quicker and more efficient, the airline companies will preferably supply the sanitary socks to each of the passengers at the time in which they obtain their boarding passes. In the alternative, such sanitary socks are supplied prior to the passenger entering the security screening station. Moreover, the present invention is preferably fabricated out of antimicrobial fiber, with antifungal, antibacterial, or antimicrobial properties. In an alternative embodiment of the invention, non-antimicrobial fibers are utilized.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sanitary security sock system for facilitating the screening of airline passengers in a secure, sanitary and efficient manner comprising, in combination:

an entrance station for airline passengers to be screened for security purposes, the entrance station including a plurality of socks, each sock being fabricated of a tubular knit with a closed end and an open end with an intermediate extent there between, the closed end having a line of closure stitching positionable adjacent to a passenger's toes and the open end having an elastic band positionable around a passenger's ankle, each sock having an elastomeric pad fabricated of an elastomer selected from the class of elastomers including plastic and rubber, natural and synthetic, and blends thereof, the pad being of a generally rectangular configuration with a width less than half the intermediate extent and a length less than the length of the tubular knit and positioned closer to the closed end than to the open end, the pads each having an upper face in secure contact by adhesive to the intermediate extent of the tubular knit and a lower face with projections in rows and columns integrally formed with the pad for traction purposes, the socks being designated "one size fits all" and arranged in pairs, the entrance station also having a plurality of containers, with each container containing pairs of socks of a common size to be selected by a passenger to be screened;

a metal detection station including opposed vertical plates adapted to detect metal there between and to generate a warning signal to an attendant upon a passenger walking between the plates if metal is on the passenger's person but to not generate a warning signal upon a passenger walking between the plates if no metal is on the passenger's person, the person walking between the plates adapted to remove his/her shoes prior to walking between the plates and to put on a pair of socks selected from a container of an appropriate size;

an x-ray detection station including an x-ray camera and a plastic tray movable beneath the x-ray camera, the tray being adapted to receive a passenger's shoes after a passenger has removed his/her shoes and then selected a pair of socks and put them on his/her feet, the tray with the pair of shoes adapted to be fed beneath the x-ray camera for the detection of objects which might be a security risk while the passenger is walking between the plates; and an exit station including a trash basket for each passenger's pair of socks after each passenger has passed through the metal detection station while wearing socks and has had his/her shoes passed beneath the x-ray camera.

2. A sanitary security sock system comprising a plurality of socks each with a closed end and an open end with an intermediate extent there between, each sock having an elastomeric pad, the pads each having an upper face in secure contact to the intermediate extent and a lower face with projections in rows and columns integrally formed with the pad for traction purposes, the socks being designated as "one size fits all" and arranged in pairs;

a plurality of containers with each container containing pairs of socks of a common size to be selected by a passenger to be screened for security purposes; and a trash basket for the pairs of socks after being screened.

3. The system as set forth in claim 2 wherein each sock is fabricated of a tubular knit with a closed end and an open end with an intermediate extent there between, the closed end having a line of closure stitching positionable adjacent to a passenger's toes and the open end having an elastic band positionable around a passenger's ankle, each sock having an elastomeric pad fabricated of an elastomer, the pad being of a generally rectangular configuration with a width less that half the intermediate extent and a length less than the length of the tubular knit and positioned closer to the closed end than to the open end, the pads each having an upper face in secure contact by adhesive to the intermediate extent of the tubular knit and a lower face with projections in rows and columns integrally formed with the pad for traction purposes.

4. The system as set forth in claim 2 wherein the pad is of an elongated configuration with a curved front edge and a curved rear edge.

5. The system as set forth in claim 2 wherein the pad is of an extended configuration with a front portion extending over a wearer's toes and a rear portion extending up the back of a wearer's ankle.

6. The system as set forth in claim 2 wherein the socks are fabricated of an antimicrobial fiber.

* * * * *